US006371755B1

(12) United States Patent
Dearth

(10) Patent No.: US 6,371,755 B1
(45) Date of Patent: Apr. 16, 2002

(54) ROLLED BUN CANDLE

(75) Inventor: Charles Dearth, Chillicothe, OH (US)

(73) Assignee: Scentual Candle, Inc., Chillicothe, OH (US)

( * ) Notice: Subject to any disclaimer, the term of this patent is extended or adjusted under 35 U.S.C. 154(b) by 0 days.

(21) Appl. No.: 09/542,108

(22) Filed: Apr. 4, 2000

(51) Int. Cl.[7] ..... F23D 3/16
(52) U.S. Cl. ..... 431/291; 431/288; 431/126
(58) Field of Search ..... 431/126, 288–293, 431/125; 264/294, 296, 295, 239; D26/6, 7, 9–11

(56) References Cited

U.S. PATENT DOCUMENTS

| | | | | |
|---|---|---|---|---|
| 1,622,347 A | | 3/1927 | Rhoads | |
| 1,937,393 A | * | 11/1933 | Root | 431/126 |
| D119,776 S | | 4/1940 | Bilkau | |
| D147,730 S | | 10/1947 | Hussey | |
| 2,461,822 A | | 2/1949 | Hussey | |
| 2,627,174 A | | 2/1953 | Weglin | |
| 2,720,099 A | | 10/1955 | Gronowski | |
| 2,974,509 A | | 3/1961 | Penke | |
| 4,855,098 A | | 8/1989 | Taylor | |
| D346,038 S | | 4/1994 | Buttermann | |
| D397,459 S | | 8/1998 | Hsu | |
| D409,316 S | | 5/1999 | Majcrowski | |

FOREIGN PATENT DOCUMENTS

| | | | | |
|---|---|---|---|---|
| DE | 2526023 | * | 12/1976 | 431/288 |
| DE | 3137597 | * | 4/1983 | 431/126 |
| GB | 1490547 | * | 11/1977 | 431/288 |

OTHER PUBLICATIONS

Muffins, Nut Breads and More; Twist rolls; p. 120, 1985.

* cited by examiner

*Primary Examiner*—James C. Yeung
(74) *Attorney, Agent, or Firm*—Porter Wright Morris & Arthur LLP

(57) ABSTRACT

A rolled candle giving the appearance of a rolled or sticky bun is presented. Also included in the invention are methods and devices for producing same. An elongated wax layer is formed, having a somewhat wide, thin end and a somewhat narrow, thick end. After adding a wick to the wider end, the candle is rolled from the wide end to the narrow end. The resulting rolled candle may then have additional adornments added, such as sprinkled cinnamon, vanilla wax to simulate icing, and wax nuts. The candle may also be formed or placed in a jar or other appropriate container.

20 Claims, 4 Drawing Sheets

ROLLED BUN CANDLE

BACKGROUND AND SUMMARY OF THE INVENTION

The fundamental process of making wax candles has continued virtually unchanged for more than a century, and thus requires no detailed description. However, it is desirable to develop new methods of imparting novel and aesthetically pleasing characteristics to the basic candle structure. The present invention satisfies this need by allowing the formation of an ornamental candle of a type for which no practical method has previously existed.

The present invention involves the formation and rolling of a shaped layer of candle wax to create an aesthetically appealing candle product. The candle product, hereinafter the rolled candle, is composed primarily of what one skilled in the art would recognize as a base wax.

In a preferred embodiment of the present invention, a method for manufacturing a shaped, rolled candle is presented. First, wax of an appropriate color and character is obtained, and is then heated until the wax is in a sufficiently liquid state. The hot, liquid wax is then poured into a substantially horizontal tray of an appropriate shape, having a first and second end. The tray preferably has an elongated base portion, first and second substantially vertical side wall portions, and first and second substantially vertical end wall portions.

The elongated base portion should be inclined such that the first end is elevated relative to said second end. The angle of incline may vary depending on the desired shape of the final rolled product, but should generally be less than 10 degrees. The first substantially vertical side wall is preferably tapered from the first end to the second end such that the separation between the first and second substantially vertical side walls is less at the second end than at the first end. The amount of taper will also vary depending on the desired shape of the final product, but will generally be less than 10 degrees. The second substantially vertical end wall may be angled so as to soften the angle of the visible end of the rolled product.

The hot candle wax is then poured into the tray. The amount of wax poured into the tray is preferably controlled such that the finished wax panel is of a particular thickness. A difference in thickness of 1/16 of an inch could result in the finished product being an inch wider than desired after rolling. The wax is then allowed to cool, forming a shaped wax layer, and removed from the tray. The shaped wax layer is then preferably rolled starting at the wide end and ending with the narrow end on the outside of the roll. It is preferred that one of the elongated edges of the shaped wax layer is kept even with each roll so as to produce a substantially planar edge of the roll which may be used as a flat bottom of the candle.

It may be necessary during any of these steps to reheat portions or all of the candle wax. This reheating may be necessary to help shape the wax, improve the workability of the wax, or improve the adhesion between rolled layers. The edges of the shaped wax layers may be rounded prior to rolling. This gives the final product a more rounded, doughy look than it may otherwise have with rectangular edges. A candlewick is then inserted into the candle using methods known or used in the art. The wick is preferably inserted in the bottom center of the wax candle and pulled up through the candle center until a portion of the wick extends outward beyond the top center of the candle. The wick may then be cut to a desired length. Heated wax may be dripped on the top surface of the rolled candle. This dripped wax not only fills in gaps in the rolled layers, but gives the appearance of a layer of icing on the rolled bun candle. The dripping wax is preferably a white wax, in order to improve the appearance of the icing upon cooling.

The candle product may also be sprinkled with a powdered, shaved, or granular substance. The substance may be sprinkled in the tray prior to pouring of the wax, on the wax layer prior to rolling, and/or on the rolled candle. The 'substance may be any appropriate substance of a desirable appearance and/or scent, such as cinnamon, sugar, flour, chocolate shavings, candied sprinkles, scented pellets, or spices.

In addition to the novel features and advantages mentioned above, other objects and advantages of the present invention will be readily apparent from the following descriptions of the drawings and preferred embodiments.

DETAILED DESCRIPTION OF THE PREFERRED EMBODIMENT(S)

The present invention is directed to a method for the manufacture of an ornamental, but functional wax candle having a unique and attractive outer surface, specifically having the appearance of a rolled bun.

Figure 1:
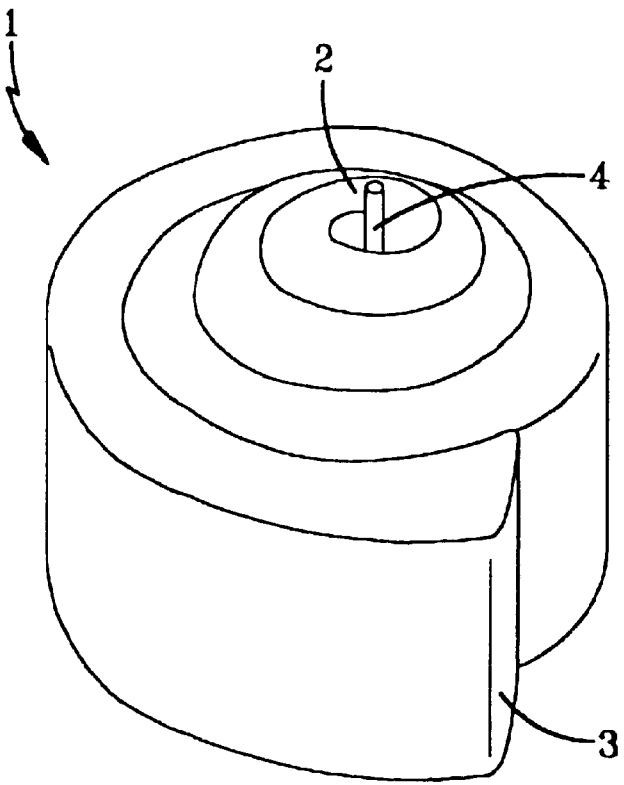
FIG. 1 is a perspective view of a rolled candle that may be used in accordance with the present invention.

FIG. 1 illustrates an example of a candle 1 produced by a method of the present invention. The candle is created by rolling a shaped, elongated wax layer. The elongated wax layer has a first end 2 and a second end 3. The layer is shaped so that the first end 2 is wider than the second end 3. The first end 2 is also thinner than the second end 3. As such, when the layer is rolled starting with the first end 2, the resulting candle will be taller in the center than at the outer edges and the layer will widen as it approaches the outer edge, simulating the appearance of a baked rolled bun. The candle 1 also has a wick 4 at its center.

Figure 2:
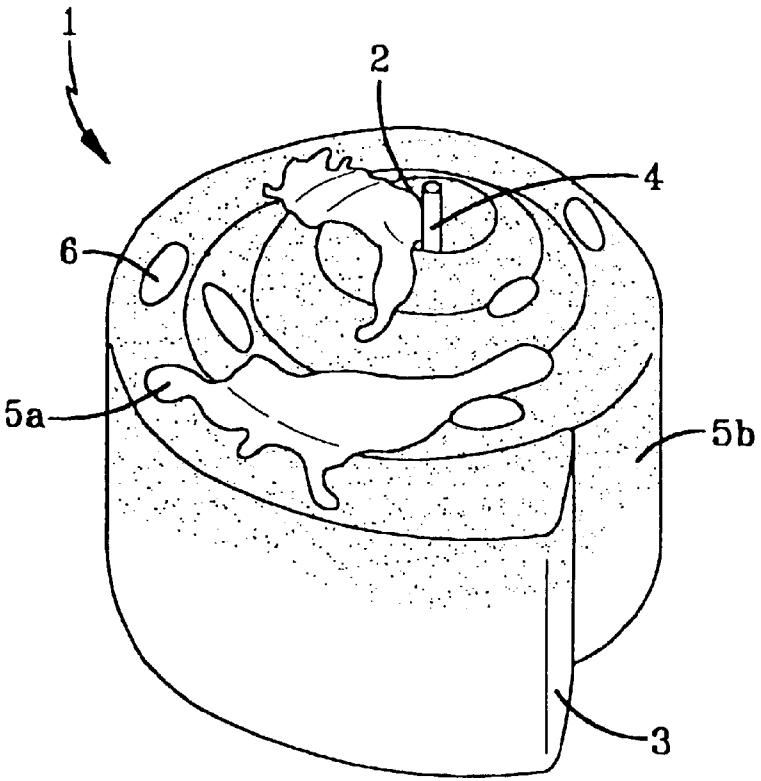
FIG. 2 is another perspective view of a rolled candle that may be used in accordance with the present invention.

FIG. 2 shows the candle 1 produced by the present invention after having additional adornments placed upon it. The candle 1 is shown with an additional layer of wax 5*a* dripped on its surface. This second wax layer 5*a*, preferably comprised of a white wax, gives the appearance of icing on the rolled bun candle. The candle is preferably also sprinkled with cinnamon 5*b* or any other appropriate substance to enhance its appearance. The candle may also have wax nuts 6 or other adornments, such as wax apples or blueberries, sprinkled on its surface for adornment. The candle may be packaged in any appropriate manner, such as by placing on a tin plate and shrink-wrapping the combination.

Figure 3:
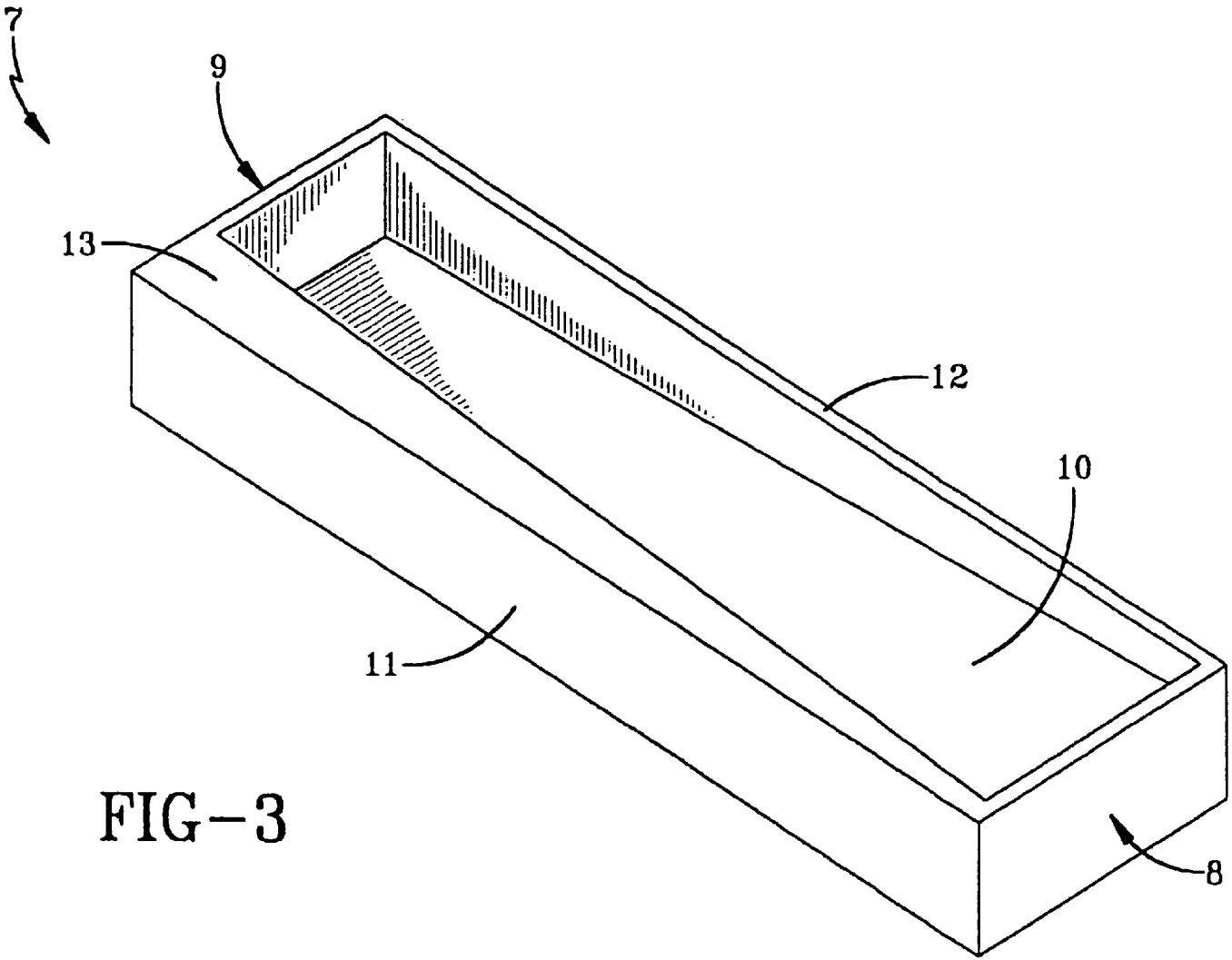
FIG. 3 is a perspective view of a shaped tray for molding candles that may be used in accordance with the present invention.

The shaped tray 7 used to mold the rollable wax layers of the present invention is shown in FIG. 3. The tray has a first end 8 and a second end 9. The tray also has a surface on the bottom of the mold 10 that inclines from the second end 9 to the first end 8. The resulting wax layer formed by the molding tray, assuming the tray is positioned substantially horizontal, will then be thicker at the second end 9 than at the first end 8.

The tray also has a first side 11 and a second side 12, each being substantially vertical. The first side 11 preferably includes a tapered region 13, either as part of or attached to the first side 11. The tapered region 13 preferably results in the molded wax being narrower at the second end 9 of the mold than at the first end 8.

The method for making a candle of the present invention preferably involves first heating appropriate candle wax until in a sufficiently liquid state. A shaped tray of the present invention is preferably sprinkled with cinnamon or other similar substance, then the heated wax is poured into the tray. The tray may be either designed so that excess wax runs over at least one of the edges of the tray, or may have marks designating the proper wax level. The level of wax is important, as an extra 1/16 inch of thickness in the wax layer can result in candles that are an inch thicker after rolling. This excess thickness may not only cause packaging problems, but raises the production cost of the candle.

As the wax starts to cool in the tray, the cinnamon or other substance is preferably again sprinkled on the wax layer, preferably putting most of the substance near the edge that will eventually be at the top of the candle. Once the wax has cooled enough to be handled as a solid, but is still pliable and workable, the wax layer may be removed from the mold and preferably laid on a flat surface. If needed, the wax can be reheated to an appropriate temperature and workability, such as by passing a propane torch over the length of the layer. The edges of the candle are then preferably rounded, such as by manually pressing on the rough edges.

Figure 4:
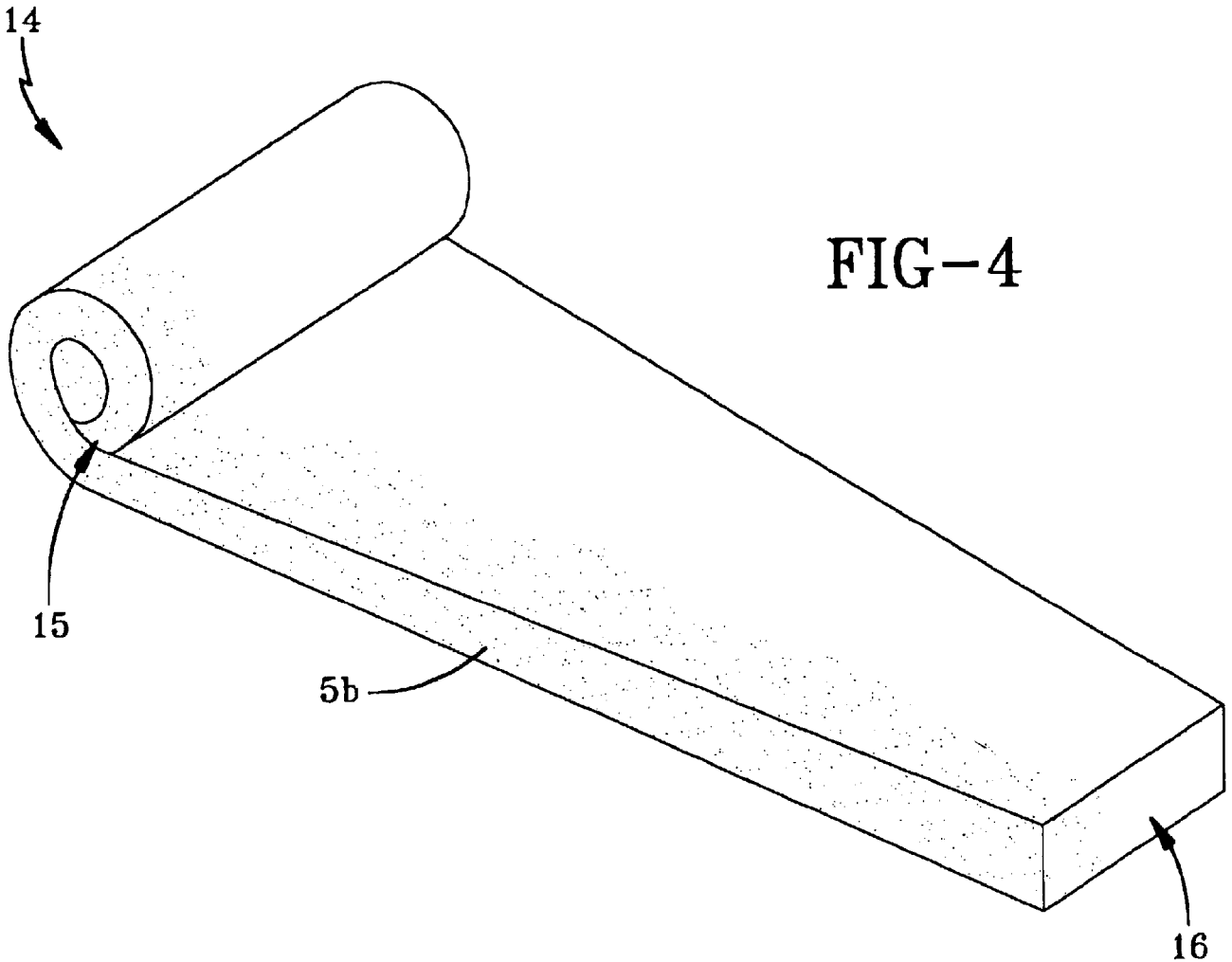
FIG. 4 is a perspective view of a partially rolled wax layer that may be used in accordance with the present invention.

The wax layer may then be rolled into the desired shaped candle, as shown in FIG. 4. Starting at the wide end 15, the wax layer 14 is rolled at an appropriate speed, attempting to keep the edge that will become the bottom of the candle even, such that a substantially planar bottom will result. During the rolling process, the wax layer may be reheated as needed. When the roll gets to the narrow end 16, the narrow end 16 is preferably reheated to ensure acceptable adhesion and prevent the candle from unraveling.

Once the candle has been rolled, it is preferably rotated and set on its bottom side. At this point, a candle wick is preferably inserted in the center of the candle from the underside of the candle. The top side of the candle may again be reheated, and an additional layer of the cinnamon or other substance preferably sprinkled on the top of the candle. A second wax, preferably a vanilla or other substantially white wax, may then be dripped on the surface of the candle. This second wax is allowed to fill any gaps in the candle roll, and also gives the appearance of icing on the rolled bun candle upon cooling. The candle may also have molded wax adornments placed upon it, such as wax nuts, apples, blueberries, or raisins. The surface of the candle may require reheating to improve adhesion of the wax.

Figure 5:
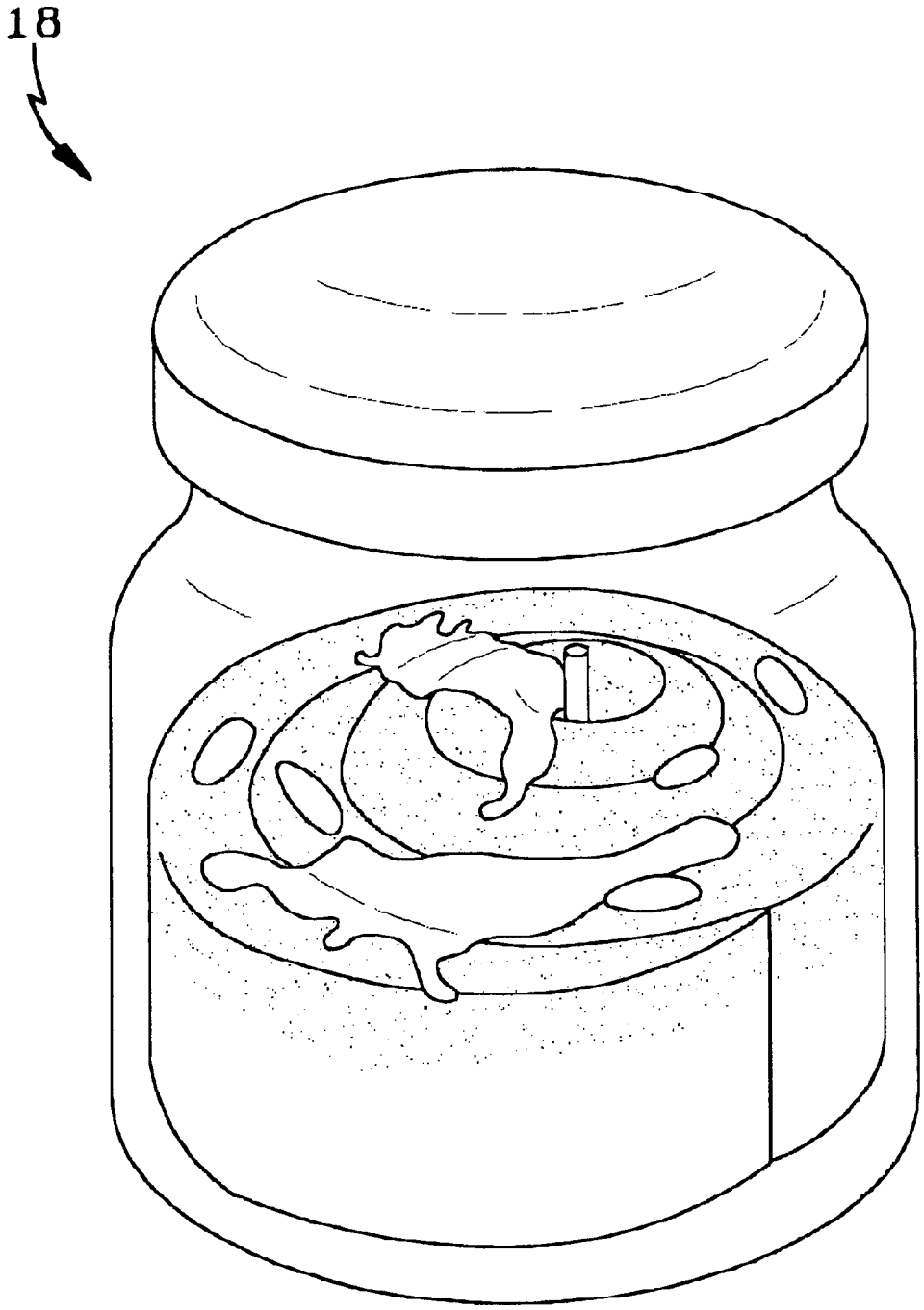
FIG. 5 is another perspective view of a rolled candle that may be used in accordance with the present invention.

As shown in FIG. 5, the candle may also be placed in a jar 18, bottle, or other wax-appropriate container. For a candle placed in a jar 18, a rectangular wax layer is preferably placed inside the jar and formed into a ring or circular structure. A flexible wax ring or other similar wax structure may also be used. It is preferred that the outer edge of the ring substantially contact the inner surface of the jar. The ends of the wax layer may be beveled, thereby improving the rolled appearance of the final product. This outer ring may often be desirable, as the mouth of a container such as a jar may be smaller than the inner body of the container. In order to then give the impression that the rolled candle fills the jar, the ring may be inserted to give the appearance of an outer layer of the rolled candle.

A thin rolled wax disc may then be inserted into the jar. The wax disc is preferably formed by rolling a thin, elongated rectangular wax piece so as to form a wax disc having a rolled appearance. The thin rolled disc is preferably of such a diameter as to fill the opening inside the wax ring at the bottom of the jar. The rolled layer is preferably no thicker than about one inch, to facilitate handling. The wax disc may then be rotated so that the outer end of the roll forming the disc substantially contacts the junction of the ends of the wax layer forming the ring. This improves the continuous roll appearance of the final product. It is preferred to use this thin wax disc, as it is easier to rotate the small disc inside the wax ring inside the jar than to rotate a larger rolled candle that substantially contacts the inner surface of the wax ring.

A rolled candle as described previously may then be inserted into the jar. The rolled candle is preferably of an appropriate diameter so as to substantially contact the inner surface of the wax ring. The rolled candle preferably sits on the thin rolled wax disc, and has an edge height such that the edges of the rolled candle are at or above the height of the surrounding wax ring. The candle may optionally sit directly on the bottom of the jar, if the thin wax layer is not used. The candle may then be rotated as described above to enhance the rolled appearance.

The rolled wax layer at the outer edge is preferably of a width similar to the thickness of the wax ring. The rolled candle preferably has a wick at its center, and preferably increases in height towards the center of the candle. The candle may have adornments similar to those described above. Each rolled candle preferably also has a warning label on its bottom side or the bottom of the container with candle safety instructions.

Another method of producing a contained rolled candle involves producing a rolled candle as described previously, and then placing the candle in a jar or other appropriate container. The candle is preferably placed into the jar while the candle is still at an elevated temperature. The candle may then expand as it cools to fill the jar.

A method for simulating a contained rolled candle involves pouring or injecting liquid candle wax into an appropriate container. Once the wax is in the container, and while it is still in a fluid state, a mold may be inserted into the container onto the surface of the wax. The mold may be adapted to expand or uncoil once in the jar so as to fill the entire inner area of the jar. A wick may also be inserted, preferably either before injecting the wax or while the wax is still sufficiently fluid. The mold is preferably of such a shape as to create a rolled appearance to the top of a candle removed from the mold. The mold is preferably held in place for an amount of time and with an amount of force sufficient to allow the wax to settle into the mold and sufficiently retain its shape after removal of the mold. The time needed may depend upon the type of wax used or the initial temperature of the wax, among other factors. Once the wax has cooled to a sufficiently solid body, the mold may be removed from the wax. A resultant candle should then give the appearance of having been rolled from a single layer of wax.

Another method for simulating a rolled candle in a jar involves pouring or injecting liquid candle wax into an appropriate container. A rolled wax layer or a molded wax layer having a rolled appearance may then be placed upon the surface of the candle wax. This may be done after the candle wax has sufficiently cooled, or while the wax is still primarily in a liquid state. The diameter of the wax layer is preferably approximately equal to the diameter of the container opening. When the wax layer is placed on the surface of the injected candle wax, the resultant candle will appear to extend continually from the top of the wax layer to the bottom of the container.

Another method for simulating a rolled candle in a jar involves inserting a rolled wax layer into the jar such that it sufficiently contacts the inner circumference of the jar. Heated candle wax is then poured or injected into the area inside the wax ring, preferably filling the open area. A wick may also be inserted, preferably either before injecting the wax or while the wax is still sufficiently fluid.

In a preferred container, where the inner diameter of the body of the container is greater than the inner diameter of the mouth of the container, the candle wax may also give the appearance to another outer layer of the candle. It is preferred that the container be transparent, and have a lid that will sufficiently prevent the aroma of the candle from escaping the container when sealed. The lid may be decorated with any appropriate designs or adornment, and may be of any appropriate material.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A form for a candle comprising:

a profile shape having a volume defined by a predetermined length between a first longitudinal end and a second longitudinal end, a width between a first lateral side and a second lateral side, and a height between an upper side and a lower side:

the height between an upper side and a lower side and the width between the first lateral side and the second lateral side at one longitudinal end of the profile differing from the height and width at the other longitudinal end, the profile shape being wound in a spiral having a perimeter determined by the length of the profile shape, the winding beginning at one of the longitudinal ends such that one lateral side of the profile shape substantially contacts the other lateral side of the profile shape in adjacent layers of the spiral.

2. The candle form of claim 1 including a wick extending through the form, the wick being positioned approximately at the center of the form.

3. The candle form of claim 1 in which at least one of the upper side and the lower side of the wound profile shape includes a taper.

4. The candle form of claim 1 in which one of the upper side and the lower side of the wound profile shape forms a substantially planar surface.

5. The candle form of claim 3 in which the taper extends from a beginning high longitudinal end to a low longitudinal end.

6. The candle form of claim 3 in which the taper extends from a beginning low longitudinal end to a high longitudinal end.

7. The candle form of claim 3 in which the taper is laterally transverse to the winding of the shape.

8. The candle form of claim 3 in which the taper is angular.

9. The candle form of claim 3 in which the taper is curvilinear.

10. The candle form of claim 1 including discrete wax particles of a predetermined shape deposited on the upper side of the wound shape.

11. The candle form of claim 1 including discrete wax particles distributed on a lateral side of the profile shape transverse to the winding.

12. The candle form of claim 1 including discrete wax particles of a predetermined shape embedded within a lateral side of the profile shape transverse to the winding.

13. The candle form of claim 1 having a wax coating on at least a portion of the wound shape.

14. The candle form of claim 13 including a wax coating applied to at least a portion of the upper surface and an external lateral side of the wound shape.

15. The candle form of claim 1 including an interstitial gap between at least one of the upper side and the lower side of adjacent lateral sides and at least a portion of the interstitial gap is filled with a wax.

16. A candle comprising:

a wax shape having a volume defined by a predetermined length between a first longitudinal end and a second longitudinal end, a width between a first lateral side and a second lateral side, and a height between an upper side and a lower side;

the height between an upper side and a lower side and the width between the first lateral side and the second lateral side at one longitudinal end of the wax shape differing from the height and width at the other longitudinal end, the wax shape being wound in a spiral having a perimeter determined by the length of the wax shape, the winding beginning at one of the longitudinal ends such that one lateral side of the wax shape substantially contacts the other lateral side of the wax shape in adjacent layers of the spiral; and one of the upper side and the lower side of the wound wax shape forms a substantially planar surface and the other of the one of the upper side and the lower side forms a surface having a taper defined by the height of the wax shape a wick extending from the wax shape, a plurality of discrete wax particles of a predetermined shape applied to at least a portion of the wax shape, and a wax coating applied to at least a portion of the wax shape.

17. The candle of claim 16 in which a plurality of discrete wax particles is deposited on the taper.

18. The candle of claim 16 in which the plurality of discrete wax particles is deposited on a lateral side of the wound shape.

19. The candle of claim 1 including a scent.

20. The candle of claim 16 including a scent.

* * * * *